US007316295B2

(12) United States Patent
Cholinski et al.

(10) Patent No.: US 7,316,295 B2
(45) Date of Patent: Jan. 8, 2008

(54) DRIVE UNIT WITH BRAKE FOR AN ELEVATOR

(75) Inventors: Andrzej Cholinski, Ebikon (CH); Heinrich Küttel, Weggis (CH)

(73) Assignee: Inventio AG, Hergiswil (CH)

( * ) Notice: Subject to any disclaimer, the term of this patent is extended or adjusted under 35 U.S.C. 154(b) by 332 days.

(21) Appl. No.: 10/365,222

(22) Filed: Feb. 12, 2003

(65) Prior Publication Data

US 2003/0155184 A1 Aug. 21, 2003

(30) Foreign Application Priority Data

Feb. 18, 2002 (EP) ..... 02405120

(51) Int. Cl.
*B66B 9/02* (2006.01)
*B66D 1/26* (2006.01)

(52) U.S. Cl. ..... 187/250; 254/302; 248/536

(58) Field of Classification Search ..... 187/250, 187/254, 299, 414; 254/901, 342; 248/674, 248/673, 676, 536, 534; 188/171
See application file for complete search history.

(56) References Cited

U.S. PATENT DOCUMENTS

| | | | | |
|---|---|---|---|---|
| 4,306,637 A | | 12/1981 | Keiser et al. | |
| 4,960,186 A | * | 10/1990 | Honda | 187/254 |
| 5,098,068 A | * | 3/1992 | Jussila | 254/342 |
| 5,148,893 A | | 9/1992 | Vertesy | |
| 5,229,780 A | * | 7/1993 | Hirotsu et al. | 343/713 |
| 5,738,339 A | * | 4/1998 | Kuryu | 254/267 |
| 6,578,672 B1 | * | 6/2003 | Miyoshi | 187/254 |
| 2001/0042662 A1 | | 11/2001 | Cholinski | |
| 2002/0100902 A1 | * | 8/2002 | Strbuncelj et al. | 254/901 |

FOREIGN PATENT DOCUMENTS

| | | |
|---|---|---|
| EP | 1 043 261 A2 | 10/2000 |
| EP | 1 069 068 A1 | 1/2001 |
| JP | 2001-355659 A * | 12/2001 |

* cited by examiner

*Primary Examiner*—Saul Rodriguz
*Assistant Examiner*—Gregory W Adams
(74) *Attorney, Agent, or Firm*—Schweitzer Cornman Gross & Bondell LLP

(57) ABSTRACT

An elevator drive unit includes an engine, an engine stand, a bearing block, a traction sheave and an engine frame with a counter-roller base. The stator of the electric drive is bolted, by means of a flange, to the engine stand. The rotor of the electric drive sits on a free end of a shaft bearing the traction sheave. The shaft is mounted to the bearing block and the engine stand. The traction sheave is mounted to the engine stand bearing block by means of the shaft. A brake is located within the engine stand and is protected by the casing.

3 Claims, 4 Drawing Sheets

DRIVE UNIT WITH BRAKE FOR AN ELEVATOR

The invention concerns a drive unit for elevators, comprising an engine, a brake and a traction sheave arranged between end shields, whereby the engine is arranged on an end shield and an engine frame carries the end shields.

BACKGROUND OF THE INVENTION

A gearless drive machine for elevators is known from patent document EP 0 468 168 B1. A machine frame carries a bearing block and a shield block. A main shaft is mounted at two points on the output side by means of a free bearing arranged on the bearing block and a fixed bearing arranged on the shield block. A traction sheave with a brake disc is provided between the bearing points. The traction sheave is firmly connected to the main shaft by means of a first clamping device. The bearing arrangement of the traction sheave on both sides permits large radial loads by small deformations of the main shaft. A hoist motor fed with alternating-current voltage consists of a stator and a rotor with a rotor hub which can be pushed onto the main shaft. At the drive-side end of the main shaft, a second clamping device provides a fixed connection between the main shaft and the rotor hub.

A disadvantage of such a well-known installation lies in that the brake is externally arranged. The brake parts can easily get dirty or can be mechanically damaged.

BRIEF DESCRIPTION OF THE INVENTION

The present invention addresses the deficiencies of the prior art and provides an elevator drive with an interiorly-mounted brake. The invention drive includes an engine, brake and traction sheave. A pair of end shields support a shaft on which the traction sheave is mounted. The brake, which acts on the sheave, is mounted to the interior surface of one of the end shields, which may comprise an engine stand and a bearing block. The construction of the end shield to which the brake is mounted provides means for accepting brake spring force.

The advantages achieved by the invention include that a drive unit with a short shaft can be constructed and, as a consequence, a small overall length of the drive unit can be obtained. Of additional benefit is the fact that the brake air cylinder and feeding lines from the brake drum can be separately located. If the brake air cylinder is hydraulically operable, the active brake surface cannot get fouled by oil in the case of leakage or conductor brake. Brake operability remains ensured.

BRIEF DESCRIPTION OF THE DRAWINGS

The invention will be more fully understood upon consideration of the following detailed description, when reviewed in association with the annexed drawings, wherein.

DETAILED DESCRIPTION OF THE INVENTION

Figure 1:
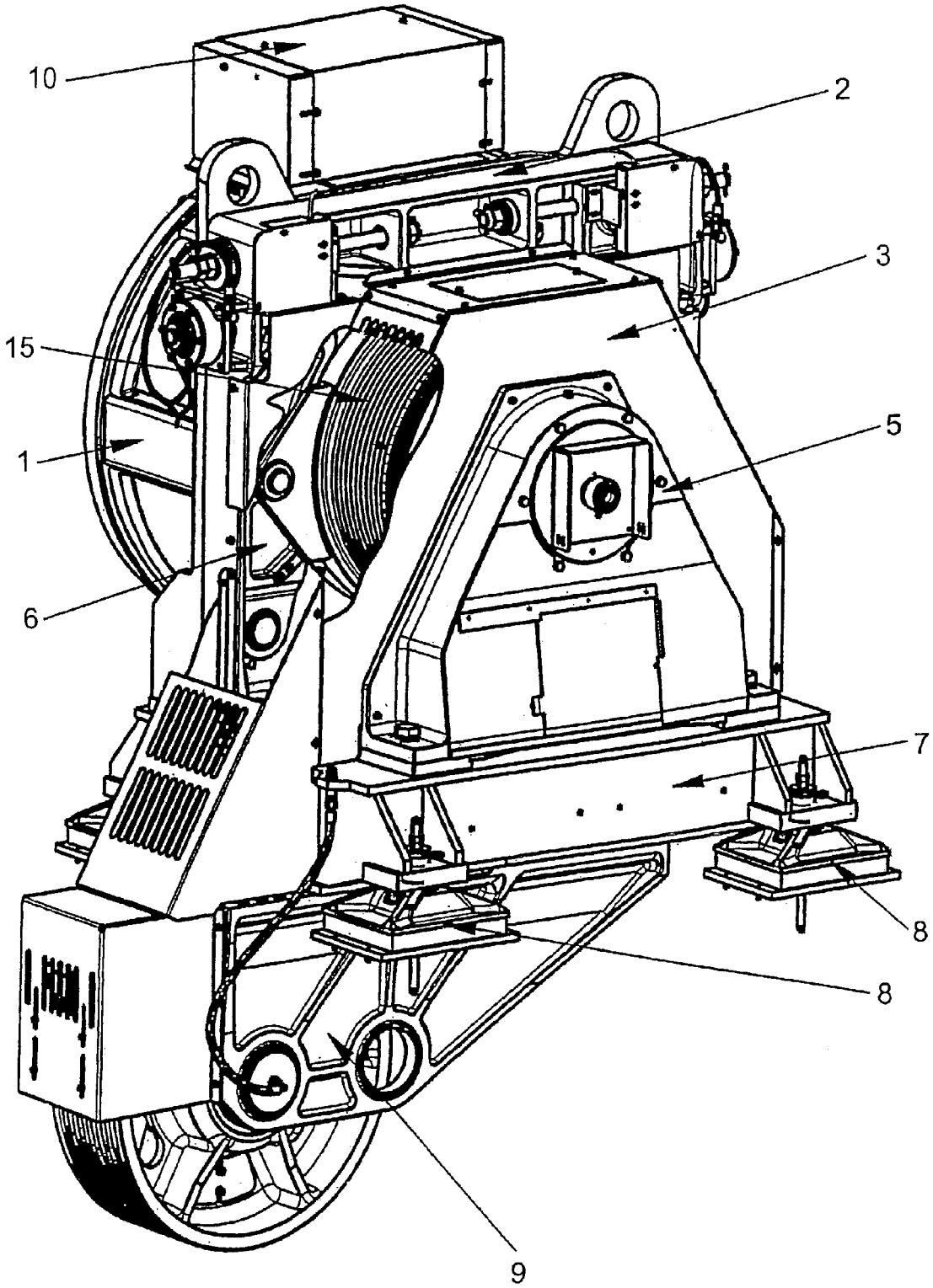
FIG. 1 is a perspective view of a drive unit according to the invention.

FIG. 1 shows an assembled drive unit, comprising an electric engine drive 1, an engine stand 2 serving as a first end shield, a bearing block 5 serving as a second end shield, a traction sheave 15 and a machine frame 7 with counter-roller base 9. The stator of the electric drive 1 is bolted, by means of a flange, to the engine stand 2. The rotor of the electric drive 1 is mounted on a free end of a shaft (not shown) bearing the traction sheave 15; the shaft is mounted to the bearing block 5 and the engine stand 2. The free shaft end extends beyond the engine stand 2. The traction sheave 15, which is visible through a broken-away section of cable protection casing 3, is mounted to the engine stand 2 and the bearing block 5 by means of the shaft. A brake 6 is arranged at the inside face of the engine stand 2 and is protected by the casing 3. Depending upon the structure of the drive unit, the brake 6 can also be positioned at the inside face of the bearing block 5.

The engine stand 2 and the bearing block 5 are arranged on the machine frame 7, which has at each of its corners an adjustable supporting element 8. The counter-roller base 9 is arranged on the lower side of the machine frame 7. All electrical connections of the drive unit are in a terminal box 10.

Figure 2A:
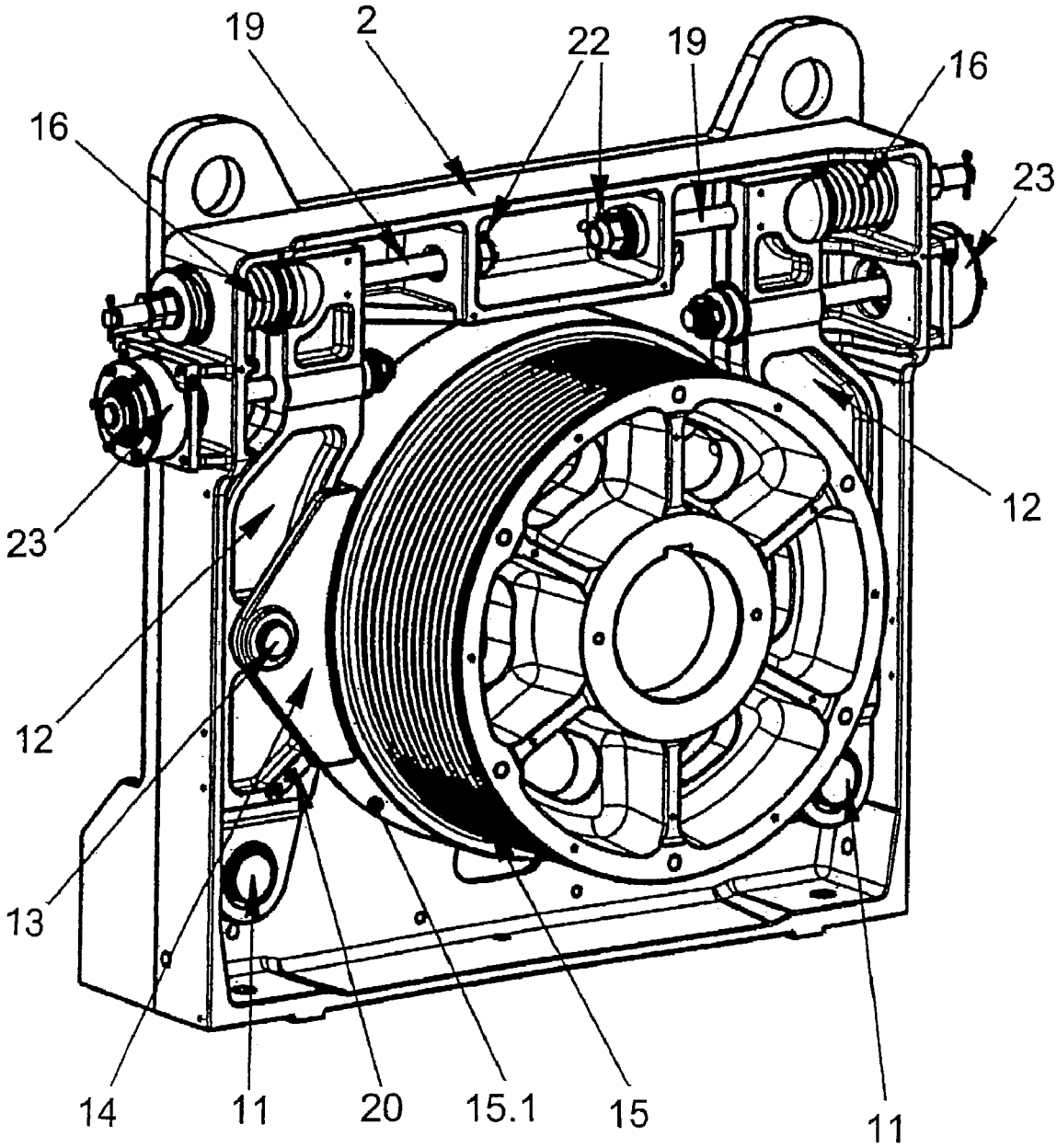
FIG. 2*a* is a perspective of the engine stand with an integrated brake and traction sheave.
Figure 2B:
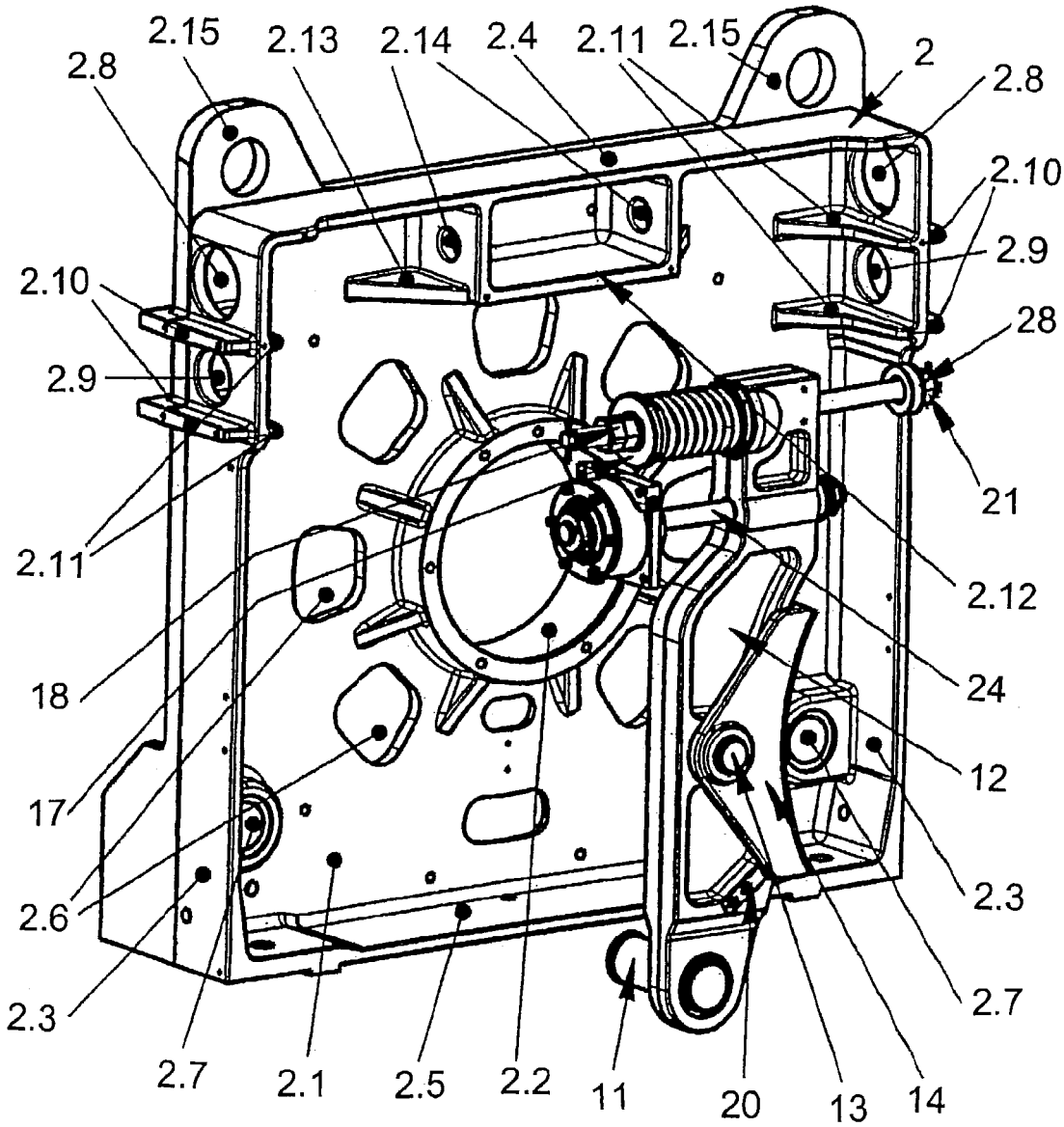
FIGS. 2*b* and 2*c* are exploded views of the engine stand of FIG. 2*a*.
Figure 2C:
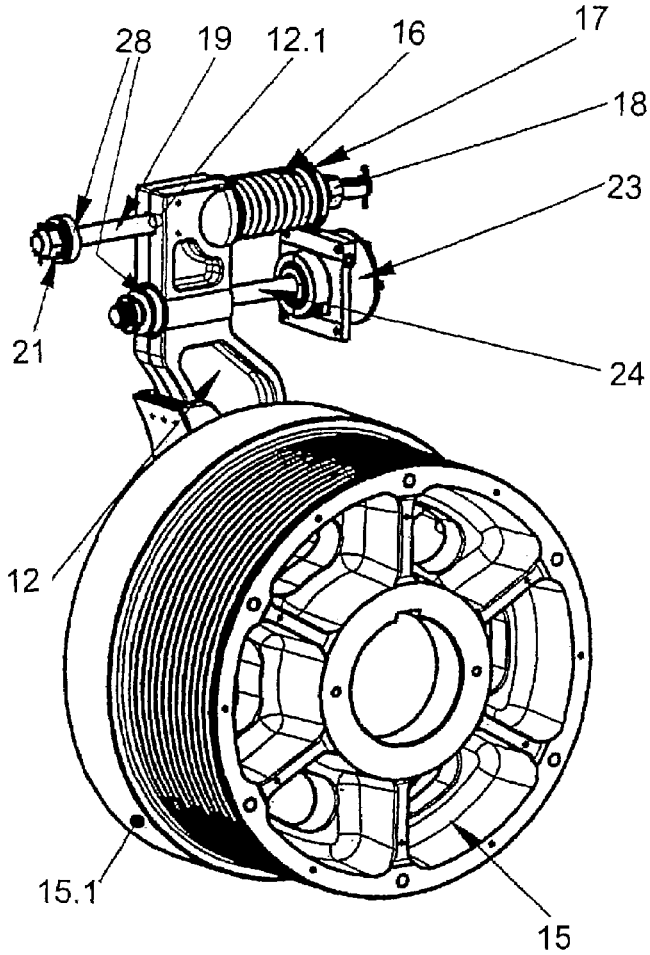

The construction of the brake 6 and the engine stand 2 is more clearly depicted in FIGS. 2*a* to 2*d*, whereby in FIG. 2*a* is to be seen an assembled view of the subassembly and in FIGS. 2*b* and 2*c* is to be seen a exploded view of the subassembly.

The engine stand 2 consists of a generally rectangular plate 2.1, which together with two vertical lateral walls 2.3 as well as upper and lower horizontal walls 2.4 and 2.5, forms the flat box-like engine stand 2. The plate 2.1 has at its center a bearing seat 2.2 for supporting the shaft on the engine side the shaft, as well as openings 2.6 for the penetration of cooling air for cooling the engine 1. Bore holes 2.7 within the lower portion of the engine stand 2 are provided for the acceptance of brake bolts 11.

The lateral walls 2.3 have, in their upper portions, openings 2.8 for flat spiral springs 16 and openings 2.9 for connecting rods 24 of the hydraulic cylinders 23. Ribs 2.10, on the external side of the walls 2.3, together with ribs 2.11 arranged on the inside, serve as a structure reinforcement and permit the taking-up of the forces, which, on operation of the brake 6, act through the hydraulic cylinders 23 on the ribs 2.10.

A U-shaped wall 2.12 on the inside of the upper wall 2.4 forms, together with the associated reinforcing ribs 2.13, a rigid structure, which takes over the spring resistance from the threaded rods 19 passed through the holes 2.14. Ears 2.15 serve for hanging the engine stand 2 or the assembled drive unit according to FIG. 1.

The brake 6 includes two air brake levers 12 mounted on the brake bolt 11; the air brake levers act on the drum 15.1 of the traction sheave 15 through the brake shoes 14 mounted on respective bolts 13. The braking force is generated by springs 16, the ends of which press on the air brake levers 12 and the other ends of which transfer the force on the threaded rods 19 to the pressure plates 17 and nuts 18. The threaded rods 19 are let through the air brake levers 12 through the holes 12.1 and in through the engine stand 2 through the holes 2.14, and are fixed with split-pins and castle nuts 21. Thus, the spring resistance is passed to the engine stand 2 through the swing bearings 22 bearing upon the inside of the U-shaped wall 2.12 of the engine stand 2.

The holes 2.14 and 12.1 are accordingly larger than the diameter of the threaded rod 19 and thus permit a rotational motion of the brake levers 12 around the axle of the bolts 11; the rotational motion is necessary for releasing the brake 6. The swing bearings 22 provide for a transfer of the forces onto the wall 2.12 of the engine stand 2 as the brake levers rotate and the swing bearings move vertically in response thereto.

An angle piece 20, which is movable and fastened to the brake lever 12, limits the freedom of movement in the downward direction of the brake shoe 14 and prevents, the contact of the brake shoes 14 with the brake drum 15.1 of the traction sheave 15 when the brake 6 is open.

Figure 2D:
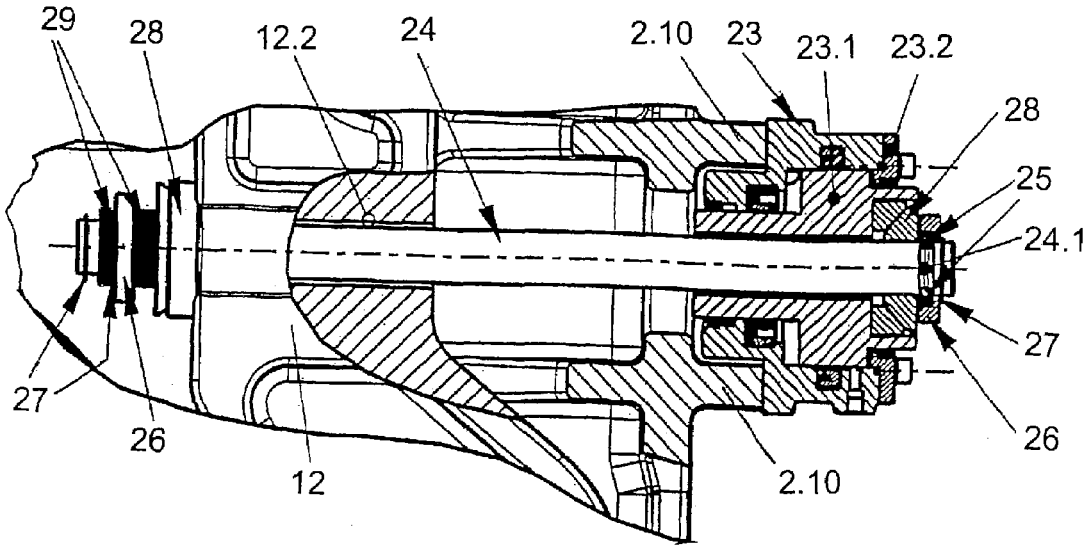
FIG. 2*d* is a section view detailing the ventilation of the brakes.

FIG. 2*d* shows details of a hydraulic cylinder 23 working against the spring resistance of a spring 16. The hydraulic cylinders 23, arranged on the ribs 2.10 on the exterior of the walls 2.3 of the engine stand 2, permit the release of the brake 6. The pressure imparted on the hydraulic cylinders 23 shifts hollow piston 23.1 outwards. The movement of the piston 23.1 is transferred to the respective brake lever 12 through the connecting rods 24. The cylinder cap 23.2 limits the movement of the piston 23.1. The connecting rod 24 has at each of its ends a slot 24.1, into which each two half rings 25 are inserted. A retaining ring 26 holds the half rings 25 in position and is itself fixed on the connecting rod 24 by the shaft safety ring 27. Axial swing bearings 28 and the correspondingly and accordingly large dimensioned holes 12.2 in the air brake levers 12 ensure that the connecting rod 24 is, in each operating condition, only axially loaded. The close tolerance spacers 29 permit the adjustment of the release travel of the air brake levers 12.

We claim:

1. A drive unit for elevators, comprising first and second spaced end shields each directly fastened to and positioned in a spaced orientation by a machine frame extending between the end shields, each of the end shields having bearings for supporting a shaft extending therebetween, the first end shield being in the form of a box of a unitary construction having an interior volume bounded by top and bottom walls and a pair of opposed side walls and an end plate wall of the end shield; a shaft-mounted traction sheave between and supported by the end shields; a brake mounted within the interior volume of the end shield box for engaging the traction sheave; and an electric drive engine mounted on an exterior of the end wall, the brake being supported by and mounted to the top wall and upper portions of the side walls; the brake comprising a brake spring and rod.

2. The drive unit according to claim 1, wherein the first end shield has an internal walled box with lateral walls and a top wall formed by a portion of the end shield top wall and connected internal ribs and a brake spring and rod assembly connected to the box, the internal ribs transferring resistance of the spring to the end shield.

3. The drive unit according to claim 1 or 2, wherein the brake is spring-activated and has brake shoes which transfer brake force to a drum of the traction sheave and cylinders arranged on the outside of the first end shield for brake release.

* * * * *